US012329333B2

(12) United States Patent
Watanabe et al.

(10) Patent No.: US 12,329,333 B2
(45) Date of Patent: Jun. 17, 2025

(54) TOILET DEVICE

(71) Applicant: TOTO LTD., Kitakyushu (JP)

(72) Inventors: Masahiko Watanabe, Kitakyushu (JP); Katsushi Maeta, Kitakyushu (JP); Fumiya Midori, Kitakyushu (JP); Yoshitaka Imamura, Kitakyushu (JP); Jun Kawamata, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 192 days.

(21) Appl. No.: 17/931,154

(22) Filed: Sep. 12, 2022

(65) Prior Publication Data

US 2023/0094041 A1 Mar. 30, 2023

(30) Foreign Application Priority Data

Sep. 30, 2021 (JP) ..... 2021-161701
Mar. 30, 2022 (JP) ..... 2022-056818

(51) Int. Cl.
*A47K 13/30* (2006.01)

(52) U.S. Cl.
CPC ..... *A47K 13/302* (2013.01)

(58) Field of Classification Search
CPC ..... A47K 13/302; A47K 13/12
USPC ..... 4/420.1, 420.4, 236, 240, 242.1
See application file for complete search history.

(56) References Cited

U.S. PATENT DOCUMENTS 7,305,720 B2 * 12/2007 Makino ..... A47K 13/28 4/236
2015/0157179 A1 * 6/2015 Li ..... A47K 13/12 4/236

FOREIGN PATENT DOCUMENTS

JP 2009024354 A * 2/2009
JP 2016-116588 A 6/2016
JP 2019136288 A * 8/2019
JP 2020117881 A * 8/2020

* cited by examiner

*Primary Examiner* — Tuan N Nguyen
(74) *Attorney, Agent, or Firm* — MCDONALD HOPKINS LLC

(57) ABSTRACT

A toilet device includes a casing, a lock part, and a release part. The casing is mounted to an upper surface of a toilet. The lock part restricts movement of the casing with respect to the toilet. The release part releases the restriction by the lock part. The release part includes an operation part and a transmission part. The transmission part transmits the operating force applied to the operation part to the lock part. The operation part is located at a position separated upward or downward from a lower end of the casing.

7 Claims, 15 Drawing Sheets

TOILET DEVICE

CROSS-REFERENCE TO RELATED APPLICATIONS

This application is based upon and claims the benefit of priority from Japanese Patent Application No. 2021-161701, filed on Sep. 30, 2021, and No. 2022-056818, filed on Mar. 30, 2022; the entire contents of which are incorporated herein by reference.

FIELD

Embodiments described herein relate generally to a toilet device.

BACKGROUND

In a known toilet device, a casing that is mounted on a toilet can be raised from the toilet to clean the upper surface of the toilet.

There is a risk that the design of such a toilet device may be constrained because the operation part for raising the casing is located at the lower end of the casing.

SUMMARY

According to the embodiment, a toilet device includes a casing, a lock part, and a release part. The casing is mounted to an upper surface of a toilet. The lock part restricts movement of the casing with respect to the toilet. The release part releases the restriction by the lock part. The release part includes an operation part and a transmission part. The transmission part transmits the operating force applied to the operation part to the lock part. The operation part is located at a position separated upward or downward from a lower end of the casing.

DETAILED DESCRIPTION

Figure 1:
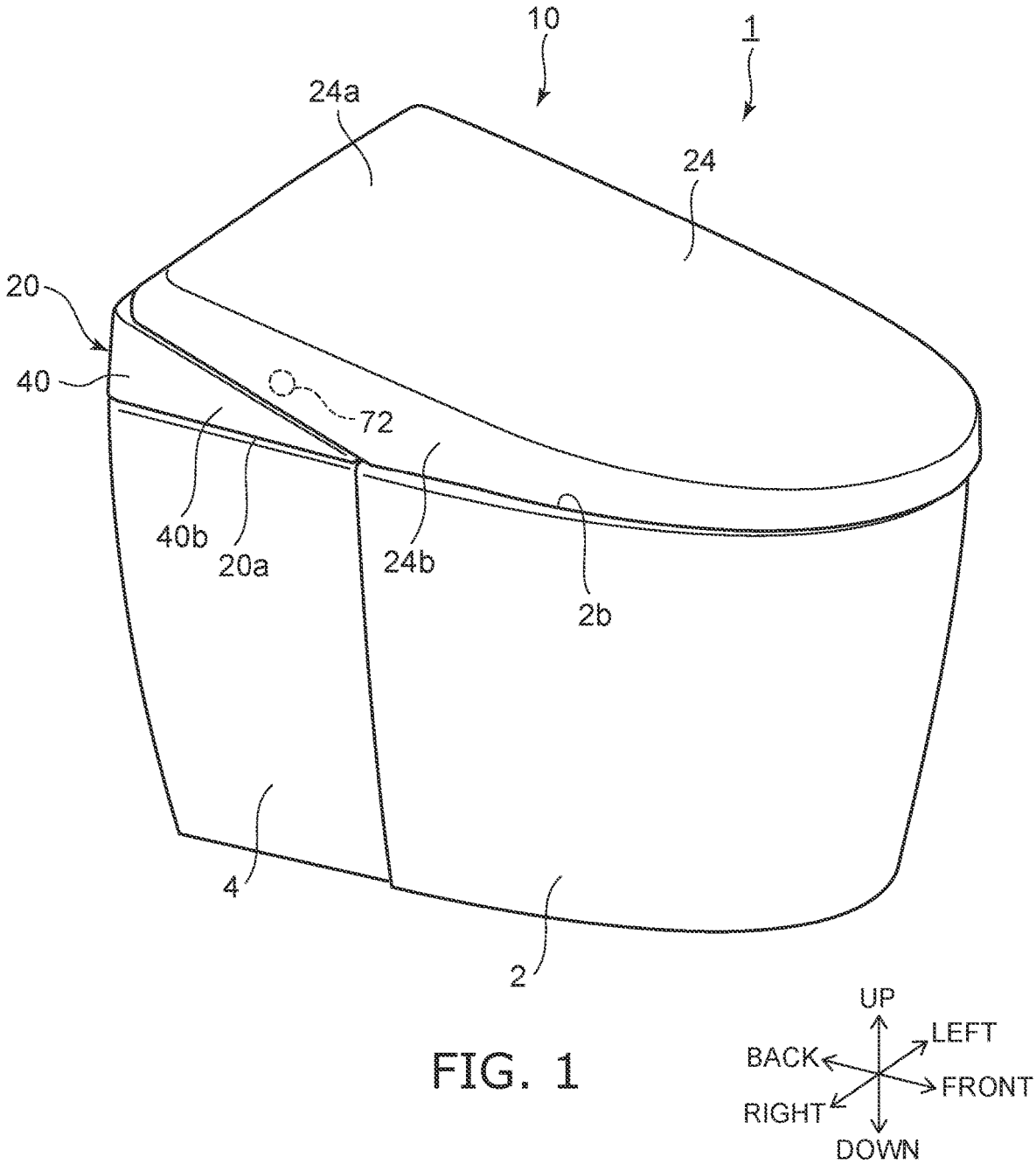
FIG. 1 is a perspective view showing a toilet device according to the first embodiment of the invention.

A first invention is a toilet device including a casing mounted to an upper surface of a toilet, a lock part restricting a movement of the casing with respect to the toilet, and a release part releasing the restricting by the lock part, wherein the release part includes an operation part and a transmission part, an operating force applied to the operation part is transmitted to the lock part by the transmission part, and the operation part is located at a position separated upward or downward from a lower end of the casing.

According to the toilet device, the designability of the toilet device can be improved by providing the operation part above or below the lower end of the casing.

A second invention is the toilet device of the first invention, wherein the operation part includes an operation surface operated by a user, and the operation surface is located at a position separated upward or downward from the lower end of the casing.

According to the toilet device, the designability can be improved.

A third invention is the toilet device of the first or second invention, wherein the operation part is located at a different position from the lock part in a vertical direction, and the transmission part includes an extension part extending in the vertical direction.

According to the toilet device, the operating force of the operation part can be efficiently transmitted to the lock part by the extension part even when the operation part and the lock part have different vertical positions.

A fourth invention is the toilet device of the third invention, wherein the transmission part includes a first part extending in a horizontal direction from the operation part, the extension part extending from the first part, and a second part extending from the extension part toward the lock part, and the casing includes a first guide part guiding the first part and a second guide part guiding the second part.

According to the toilet device, the movement of the transmission part can be smooth due to the first guide part guiding the first part of the transmission part and the second guide part guiding the second part of the transmission part. Thereby, the operating force of the operation part can be efficiently transmitted to the lock part.

A fifth invention is the toilet device of the fourth invention, wherein the lock part includes a case part and a tab part, the tab part is located inside the case part and restricts a movement of the casing, the transmission part includes a third part that extends from the second part toward the interior of the lock part and moves the tab part, and the case part includes a third guide part guiding the third part.

According to the toilet device, the operating force of the operation part can be efficiently transmitted to the tab part by the third guide part guiding the third part of the transmission part.

A sixth invention is the toilet device of the fourth or fifth invention, wherein the extension part extends obliquely downward from the first part toward the second part.

According to the toilet device, the designability can be improved by the operation part being positioned higher due to the extension part. Also, a reduction of the transmission efficiency of the force due to the extension part can be suppressed.

A seventh invention is the toilet device of the sixth invention, wherein the extension part extends toward the second part from a central position of a vertical height dimension of an operation surface of the operation part, and a dimension in the vertical direction of the extension part is not less than half of a length from an upper end to a lower end of the operation surface of the operation part.

According to the toilet device, the operation surface of the operation part can be located higher than the lower end of the casing, and the designability can be improved. Also, the operating force can be most efficiently transmitted because the extension part extends from the central part of the vertical height dimension of the operation surface.

An eighth invention is the toilet device of a seventh invention, wherein a dimension of the extension part in a lateral direction is not less than a dimension of the extension part in the vertical direction.

According to the toilet device, a reduction of the transmission efficiency can be suppressed because the angle of the extension part is not more than 45 degrees when referenced to the horizontal direction along which the operating force acts. By suppressing the reduction of the transmission efficiency, the degree of freedom of the operation surface location can be increased, and the operation surface can be located higher than the lower end of the casing. The designability can be improved thereby.

A ninth invention is the toilet device of any one of the first to eighth inventions, wherein the operation part is located at a position that is not less than 1 mm in a vertical direction from the lower end of the casing.

According to the toilet device, the designability of the toilet device can be improved.

A tenth invention is the toilet device of any one of the first to ninth inventions, and further includes a toilet lid that is openable and closable with respect to the casing, wherein the operation part is located at a position separated upward from the lower end of the casing, and the operation part is covered with the toilet lid when the toilet lid is in a closed state.

According to the toilet device, the designability of the toilet device can be improved because the operation part is not visible when the toilet lid is in the closed state.

Toilet devices of embodiments of the invention will now be described with reference to FIGS. 1 to 15. Similar components in the drawings are marked with the same reference numerals; and a detailed description is omitted as appropriate. FIGS. 1 to 13 show a first embodiment of the invention.

FIG. 1 is a perspective view showing a toilet device according to the first embodiment of the invention.

Figure 2:
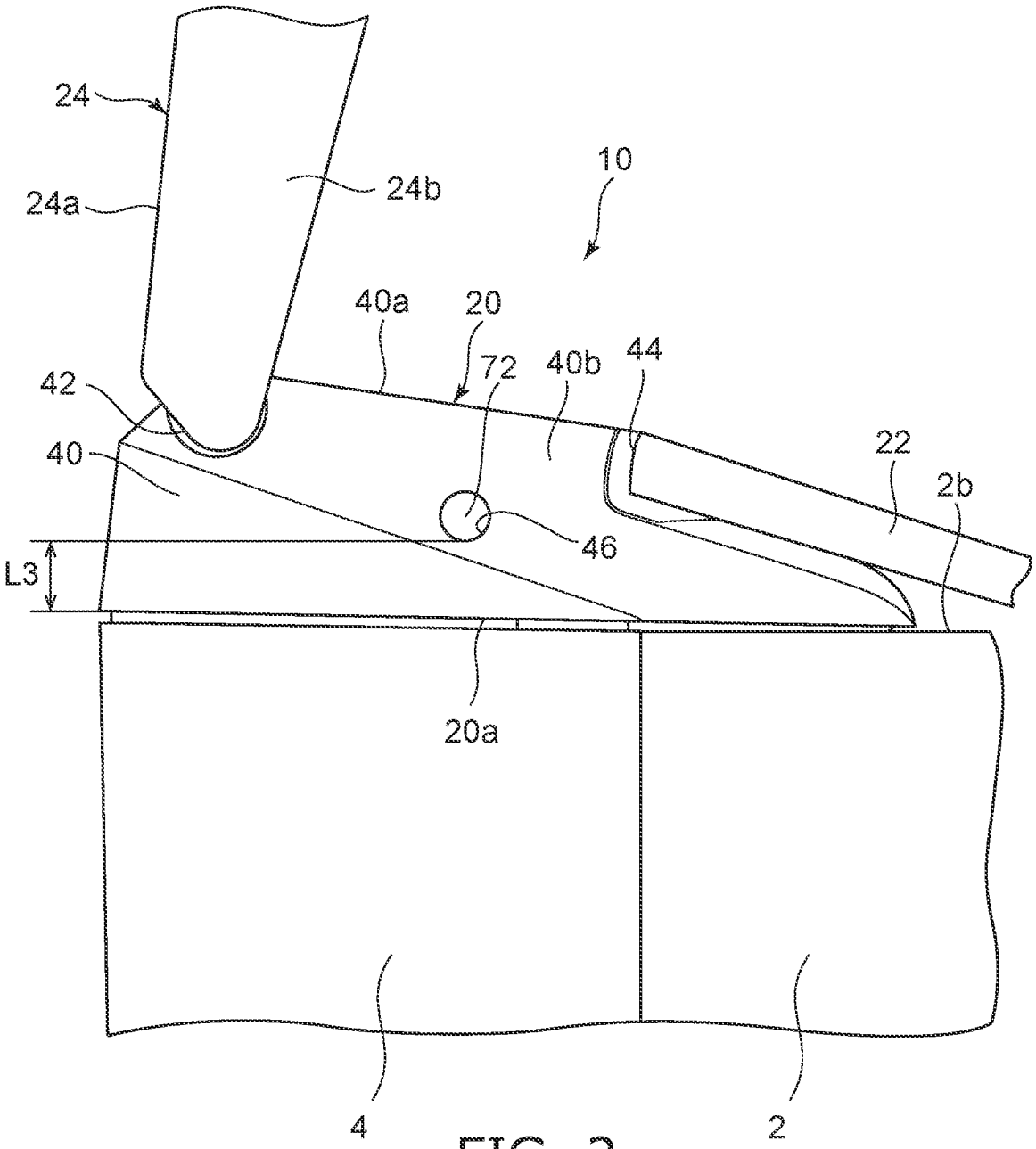
FIG. 2 is a side view showing a state in which the toilet lid of the toilet device is open.

FIG. 2 is a side view showing a state in which the toilet lid of the toilet device is open.

Figure 3:
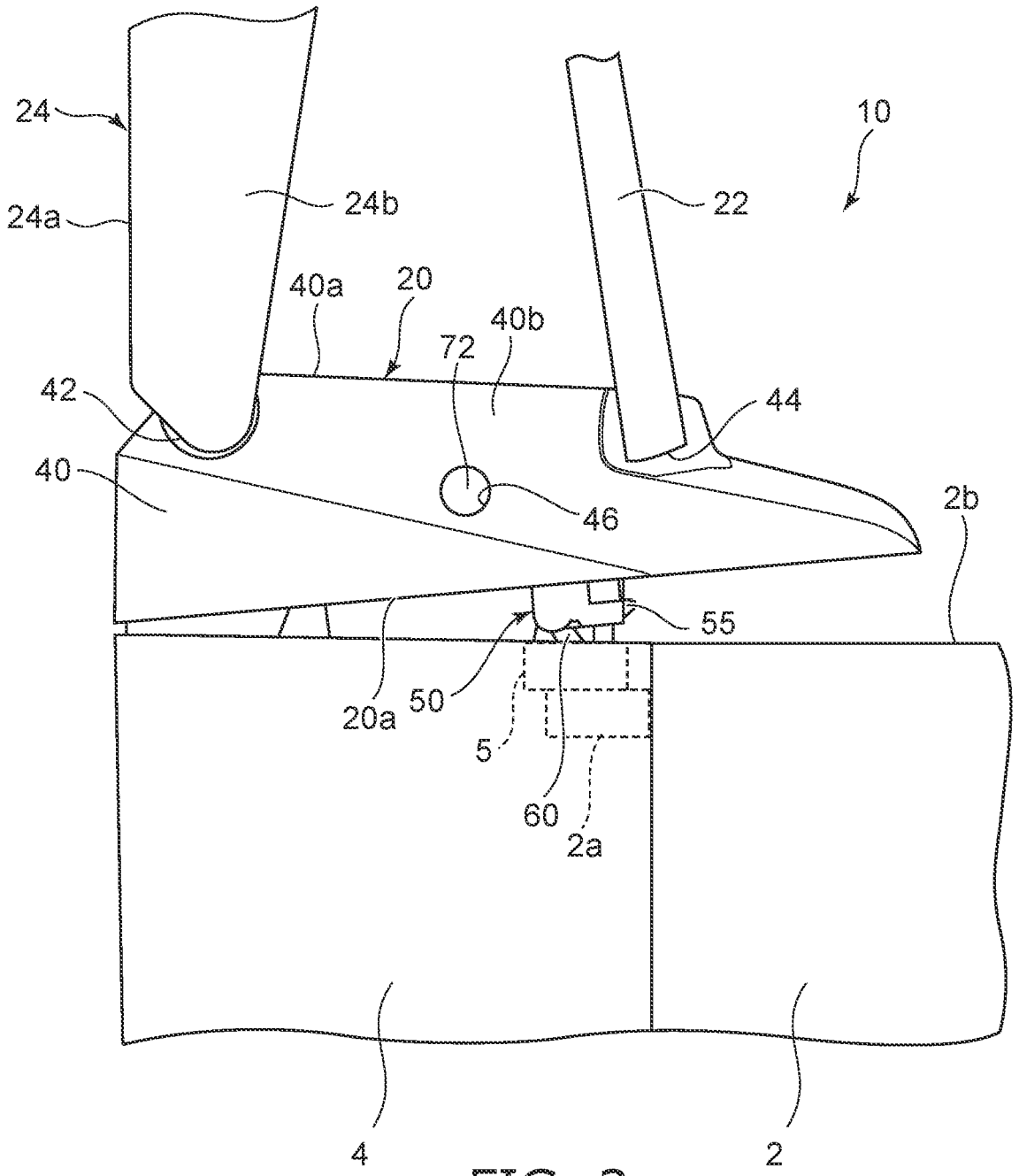
FIG. 3 is a side view showing a state in which the casing of FIG. 2 is raised.

FIG. 3 is a side view showing a state in which the casing of FIG. 2 is raised.

Figure 4:
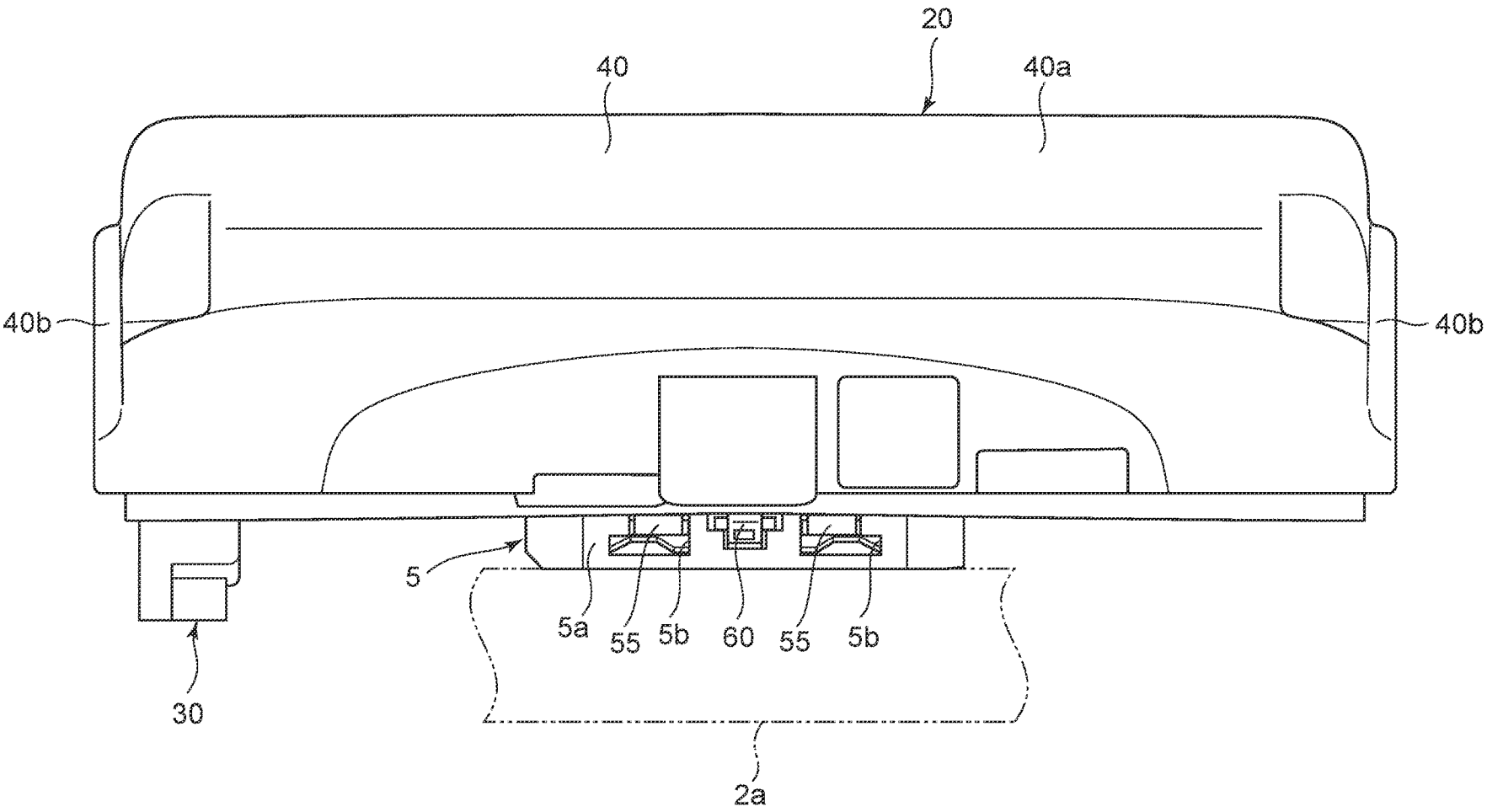
FIG. 4 is a front view of the casing of FIG. 2 when viewed from the front.

FIG. 4 is a front view of the casing of FIG. 2 when viewed from the front.

Figure 5:
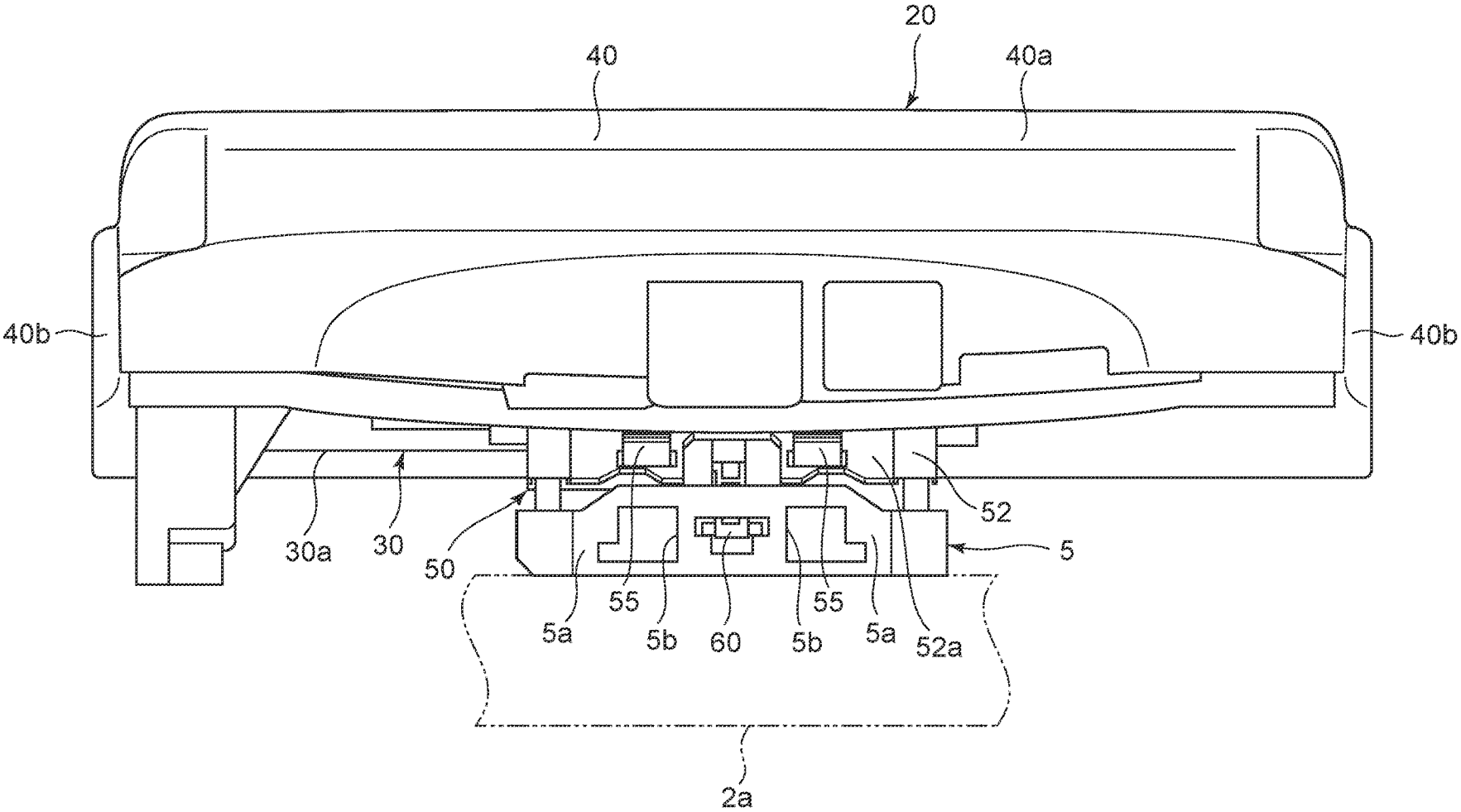
FIG. 5 is a front view of the casing of FIG. 3 when viewed from the front.

FIG. 5 is a front view of the casing of FIG. 3 when viewed from the front.

Although "up", "down", "front", "back", "right", and "left" are used in the description of the embodiments below, these are directions when viewed by a user sitting on the toilet seat as shown in FIG. 1.

As shown in FIG. 1, the toilet device 1 includes a western-style sit-down toilet (for convenience of the following description, called simply the "toilet") 2, and a toilet seat device 10 located above the toilet 2. The toilet 2 receives excrement such as urine, feces, etc., of the user in a bowl that is recessed downward.

A space that stores a tank and/or various functional units is formed backward of the toilet 2. A side surface cover 4 extends backward from the toilet 2 and covers the side of the space. As shown in FIG. 3, the toilet 2 includes a protruding part 2*a* protruding into the space. The protruding part 2*a* is positioned at the central part of the toilet 2 in the lateral direction. As shown in FIGS. 4 and 5, the protruding part 2*a* includes an engaging part 5 that is engaged by a tab part 55 of a lock part 50 described below.

The engaging part 5 is located at the upper surface of the protruding part 2*a* and is formed in a box-like shape with an open top. Two through-holes 5*b* are formed in the engaging part 5 to extend through a front surface part 5*a* in the longitudinal direction, and are separated from each other in the lateral direction. The tab part 55 of the lock part 50 is inserted through the through-hole 5*b*. As shown in FIG. 4, the lock part 50 described below is stored inside the engaging part 5 in the state in which the toilet seat device 10 is positioned at an upper surface 2*b* of the toilet 2. On the other hand, as shown in FIG. 5, the lock part 50 is raised through the opening of the engaging part 5 in the state in which the toilet seat device 10 is raised from the upper surface 2*b* of the toilet 2.

The toilet seat device 10 includes a casing 20 mounted to the upper surface 2*b* of the toilet 2, the lock part 50 restricting the movement of the casing 20 with respect to the toilet 2, and a release part 70 releasing the restriction by the lock part 50. As shown in FIGS. 2 to 5, the toilet seat device 10 can raise the casing 20 from the toilet 2.

The casing 20 includes a case plate 30, and a case cover that is detachable from the case plate 30. The toilet seat device 10 also includes a toilet seat 22 and a toilet lid 24 that are rotatable with respect to the case cover 40. The toilet lid 24 includes an upper surface part 24*a* covering the toilet 2 from above, and a side surface part 24*b* extending downward from the end part of the upper surface part 24*a*. The side surface part 24*b* of the toilet lid 24 covers at least a part of a side surface part 40*b* of the case cover 40 in the state in which the toilet lid 24 is closed.

Figure 6:
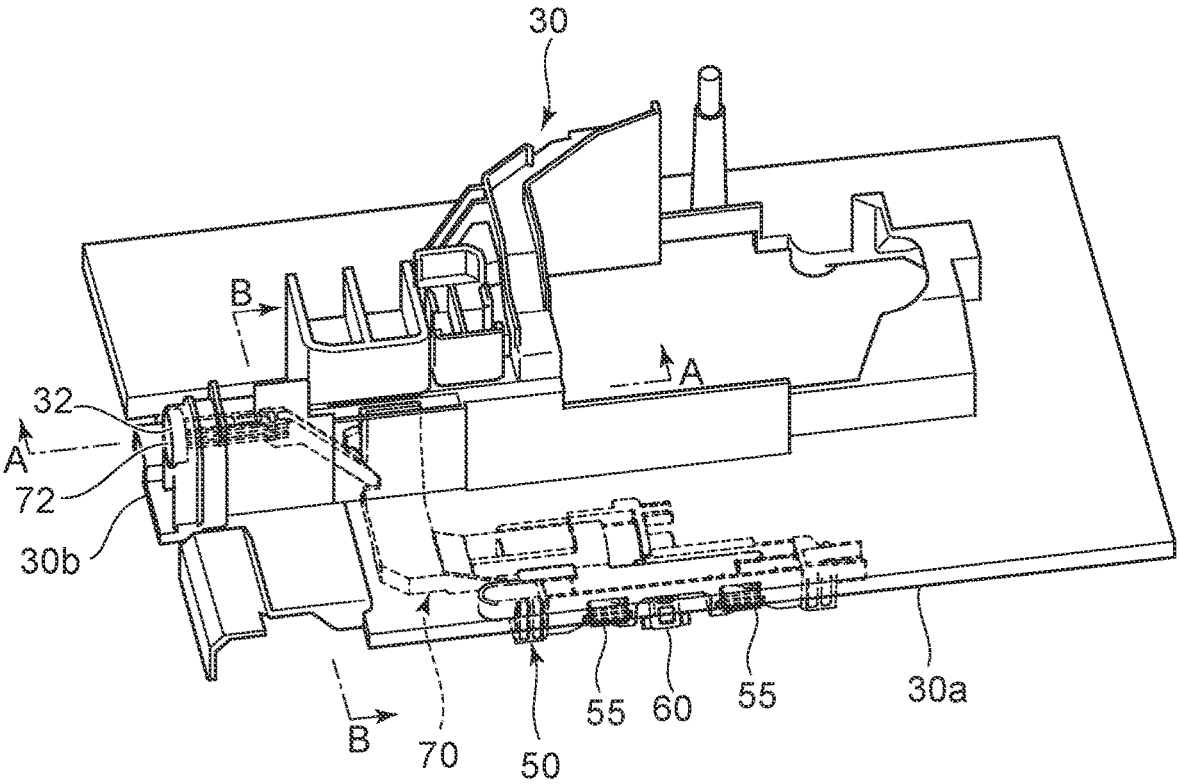
FIG. 6 is a perspective view showing the case plate of the casing, the lock part, and the release part.

FIG. 6 is a perspective view showing the case plate of the casing, the lock part, and the release part.

Figure 7:
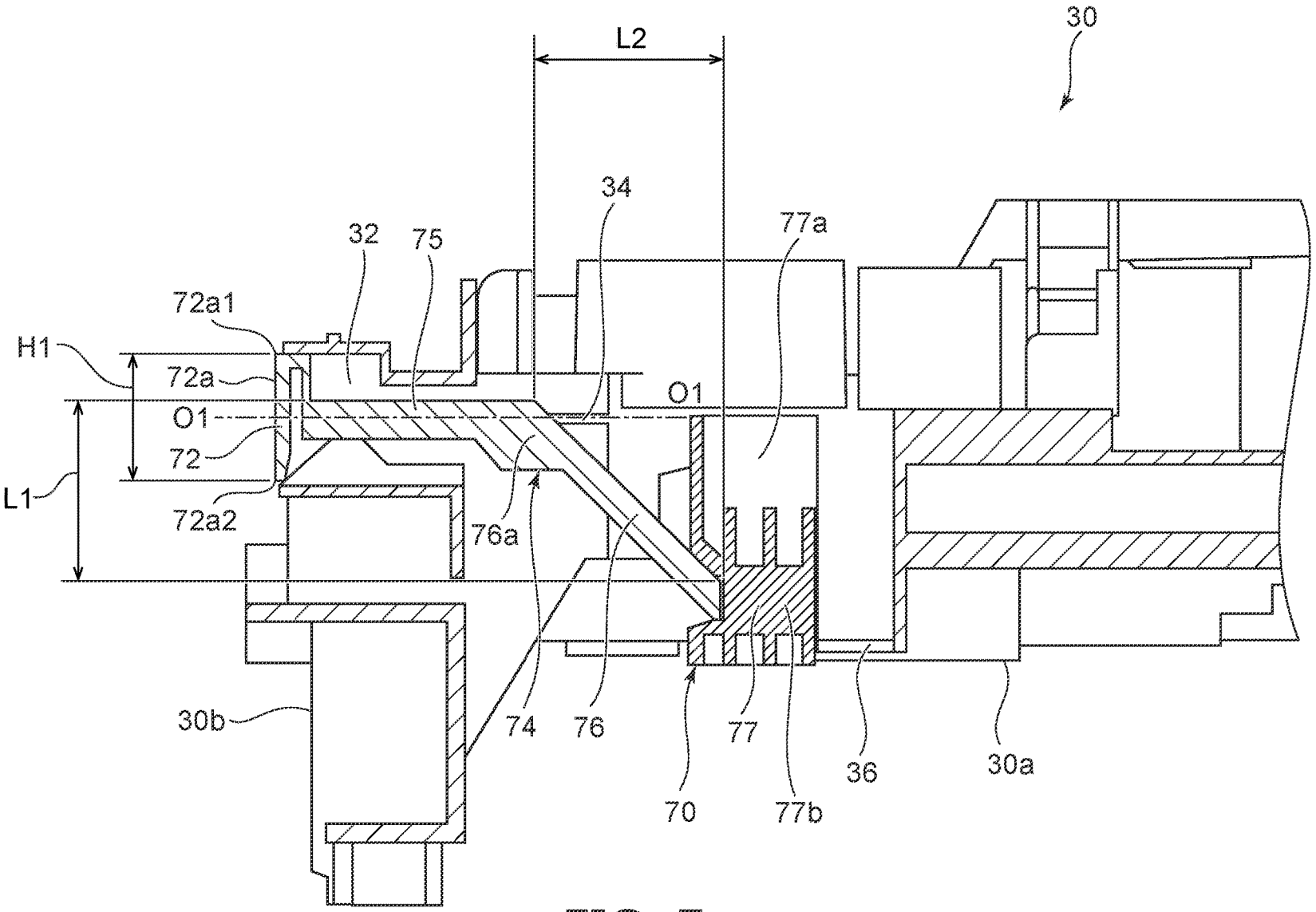
FIG. 7 is a cross-sectional view of the case plate and the release part when viewed from the arrow A-A-direction of FIG. 6.

FIG. 7 is a cross-sectional view of the case plate and the release part when viewed from the arrow A-A-direction of FIG. 6.

Figure 8:
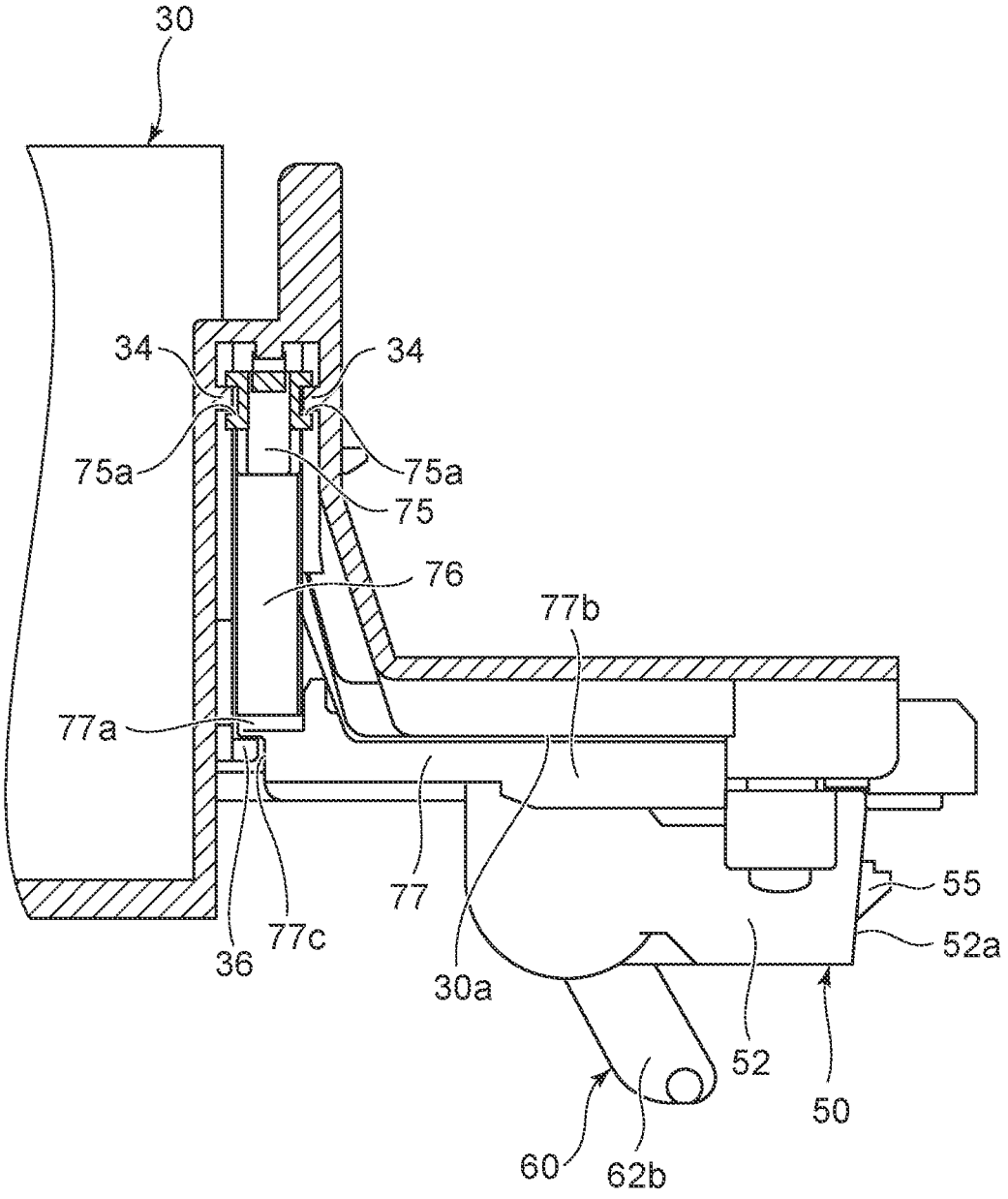
FIG. 8 is a cross-sectional view of the case plate and the release part when viewed from the arrow B-B-direction of FIG. 6.

FIG. 8 is a cross-sectional view of the case plate and the release part when viewed from the arrow B-B-direction of FIG. 6.

Figure 9:
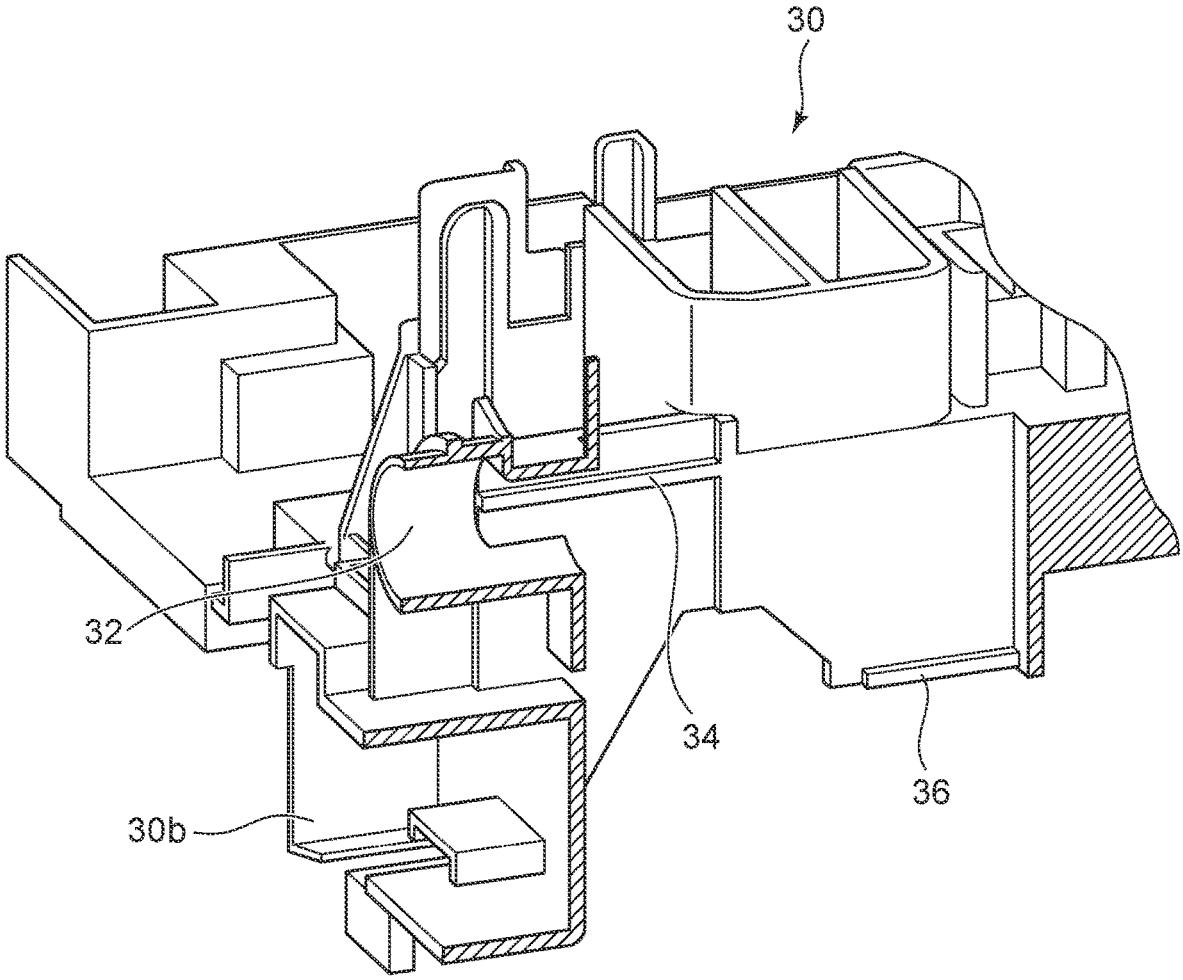
FIG. 9 is a cross-sectional perspective view showing a state in which the operation part and the transmission part are detached from the case plate.

FIG. 9 is a cross-sectional perspective view showing a state in which the operation part and the transmission part are detached from the case plate.

Figure 10:
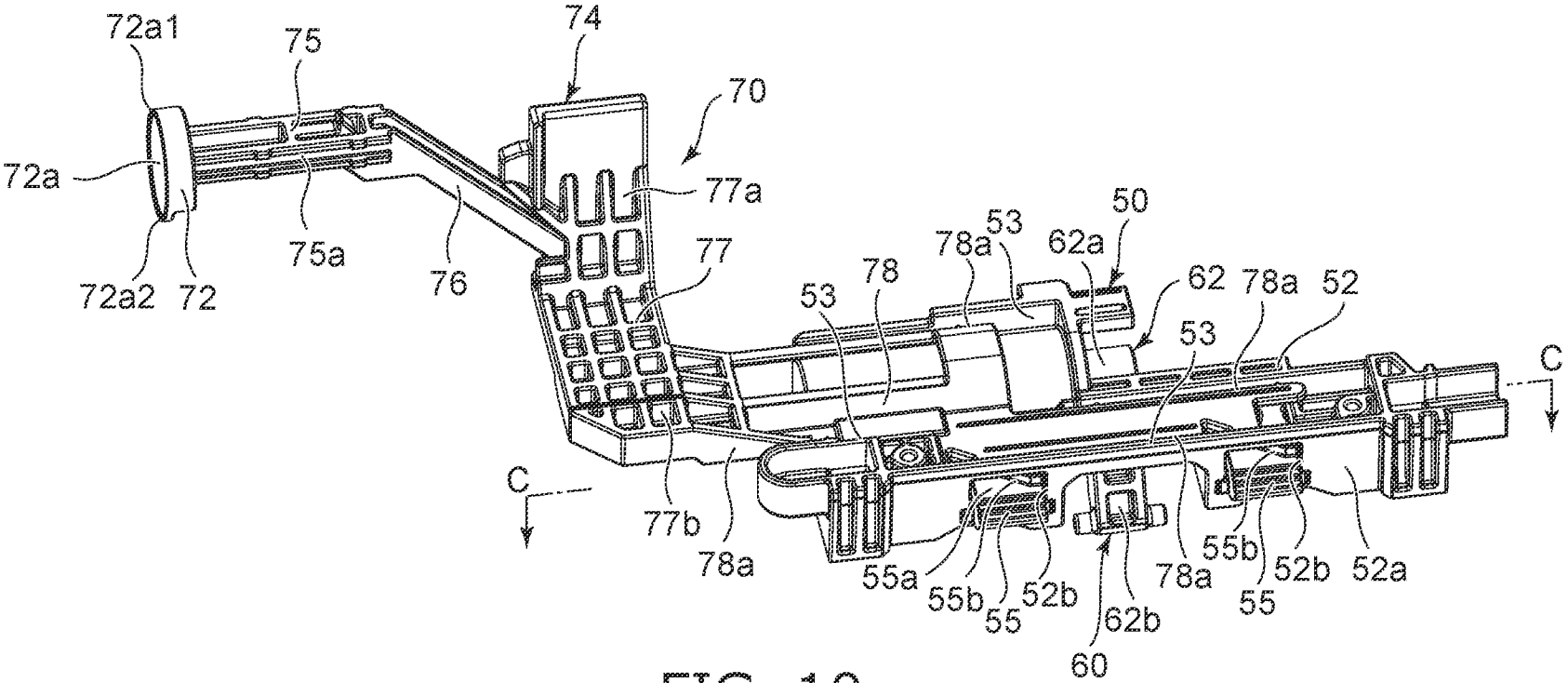
FIG. 10 is a perspective view showing the lock part and the release part.

FIG. 10 is a perspective view showing the lock part and the release part.

Figure 11:
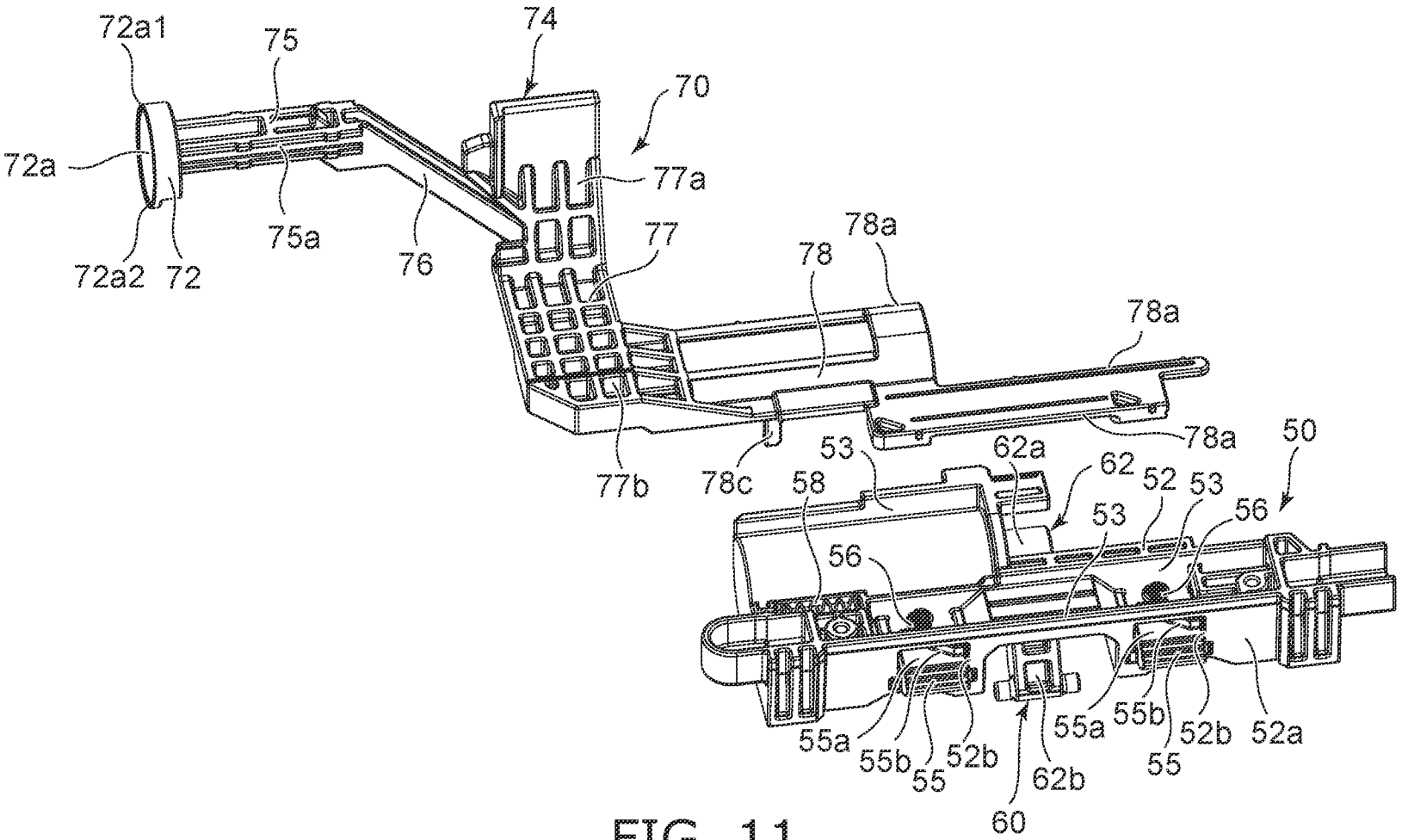
FIG. 11 is an exploded perspective view showing a state in which the release part is detached from the lock part.

FIG. 11 is an exploded perspective view showing a state in which the release part is detached from the lock part.

Figure 12:
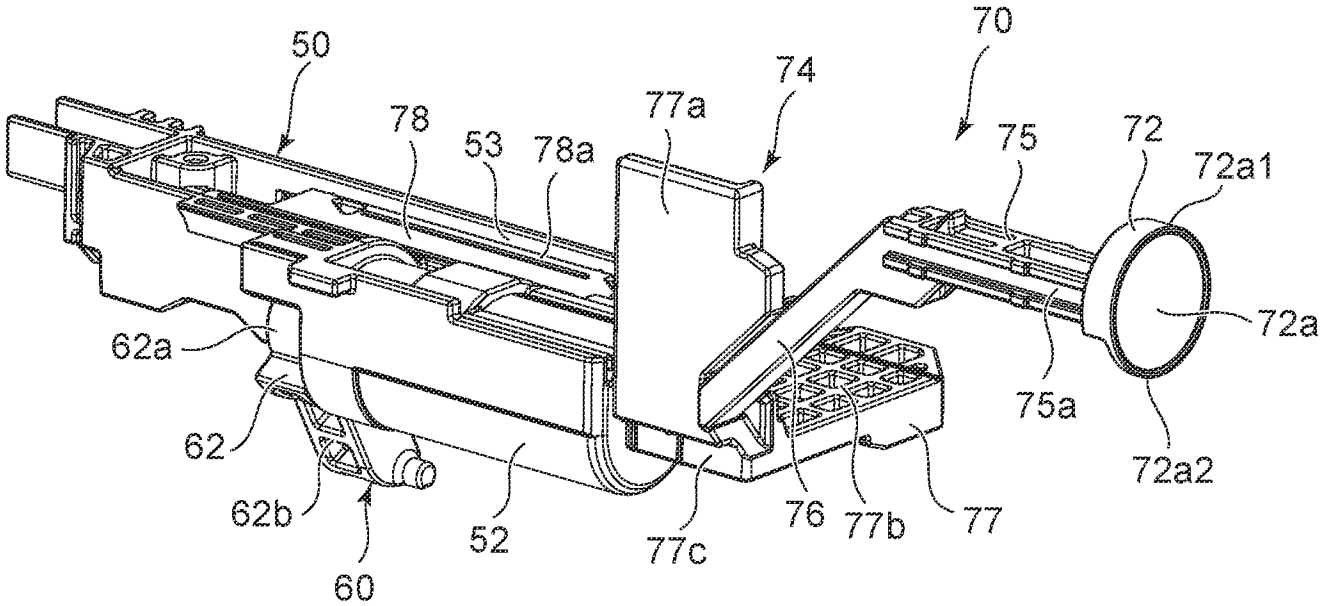
FIG. 12 is a perspective view of the lock part and the release part shown in FIG. 10 when viewed from the opposite side.

FIG. 12 is a perspective view of the lock part and the release part shown in FIG. 10 when viewed from the opposite side.

Figure 13:
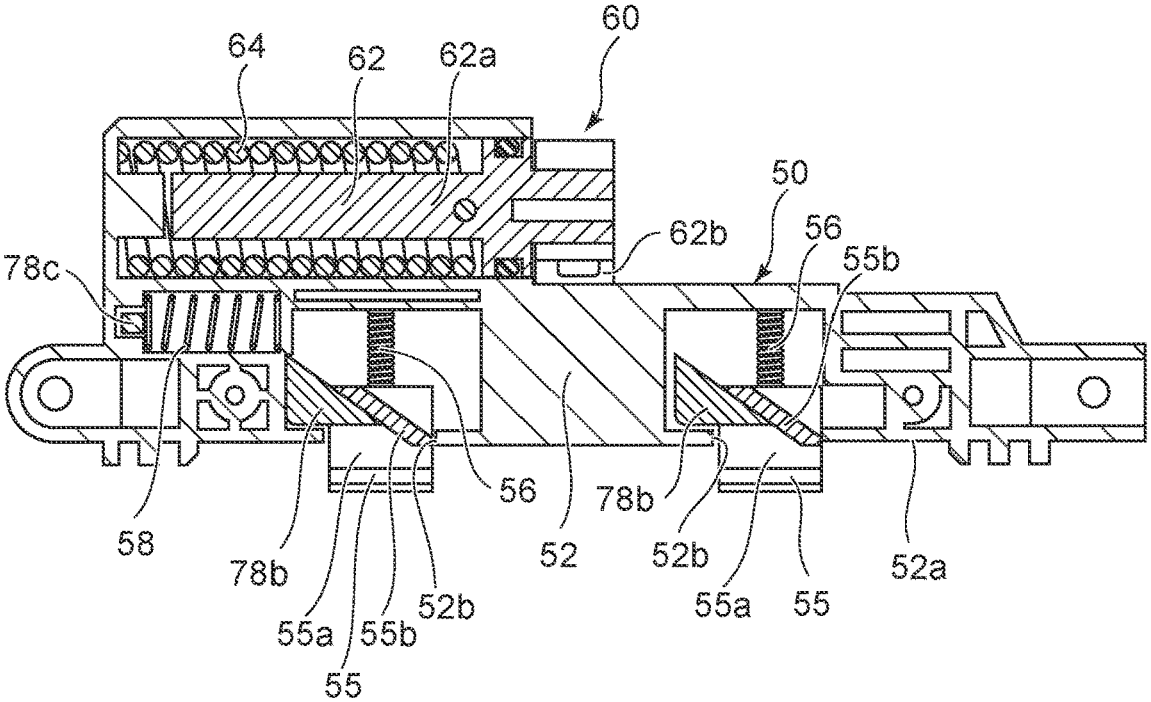
FIG. 13 is a cross-sectional view of the lock part and the transmission part when viewed from the arrow C-C-direction of FIG. 10.

FIG. 13 is a cross-sectional view of the lock part and the transmission part when viewed from the arrow C-C-direction of FIG. 10.

The case plate 30 covers the bottom part of the casing 20. Various functional units (not illustrated) such as a deodorizing device, a pipe line, etc., are located in the case plate 30. The lock part 50 is mounted to a lower surface part 30*a* of the case plate 30 at a position corresponding to the engaging part 5.

An operation part mounting hole 32 in which an operation part 72 described below is mounted is provided in a side surface part 30*b* of the case plate 30. The operation part mounting hole 32 is through-hole that extends in the lateral direction. As shown in FIGS. 6 to 9, the operation part mounting hole 32 is positioned at the upper-end side of the case plate 30. In other words, the operation part mounting hole 32 is positioned higher than the lock part 50. As shown in FIGS. 7 to 9, the case plate includes a first guide part 34 and a second guide part 36 that guide a transmission part 74 described below.

As shown in FIG. 9, the first guide part 34 is next to the operation part mounting hole 32 in the lateral direction. The first guide part 34 is a rail part extending in the lateral direction from the operation part mounting hole 32. In other words, the first guide part 34 extends in the same direction as the axial direction of the operation part mounting hole 32. As shown in FIG. 8, two first guide parts 34 face each other in the longitudinal direction and protrude from the wall surfaces. The first guide parts 34 slidably guide a first part 75 of the transmission part 74 described below.

The second guide part 36 is positioned lower than the first guide part 34 and further toward the central part. The second guide part 36 is positioned at the lower surface part 30*a* side of the case plate 30. In other words, the second guide part 36 is positioned at substantially the same height as the upper end of the lock part 50 and is located between the first guide part 34 and the lock part 50. The second guide part 36 is a rail part extending in the lateral direction and protrudes from the wall surface. The second guide part 36 slidably guides a second part 77 of the transmission part 74 described below.

The case cover 40 is formed in a box-like shape with an open bottom, and is mounted to the case plate 30. The case cover 40 includes an upper surface part 40*a*, and the side surface part 40*b* extending downward from the end part of the upper surface part 40*a*.

As shown in FIGS. 2 to 5, the side surface part 40*b* of the case cover 40 includes a toilet lid mounting part 42 at which the toilet lid 24 is rotatably mounted, and a toilet seat mounting part 44 at which the toilet seat 22 is rotatably mounted. The toilet lid mounting parts 42 are positioned at the back end side of the case cover 40 and are located at the two lateral end sides. The toilet seat mounting parts 44 are positioned further frontward than the toilet lid mounting part 42 and are located at the two lateral end sides.

The side surface part 40*b* of the case cover 40 includes an opening 46 between the toilet lid mounting part 42 and the toilet seat mounting part 44. The opening 46 is located at the position of the case plate 30 corresponding to the operation part mounting hole 32 and extends through the case plate 30 in the lateral direction. The opening 46 is positioned higher than a lower end 20*a* of the casing 20 (the case cover 40). The opening 46 is a hole part for operating the operation part 72 described below.

The lock part 50 will now be described.

The lock part 50 is mounted to the lower surface part 30*a* of the case plate 30. The lock part 50 restricts the upward movement of the casing 20 by engaging the engaging part 5 fixed to the toilet 2. As shown in FIGS. 2 and 4, the lock part 50 is stored inside the engaging part 5 in the state in which the casing is not raised. On the other hand, As shown in FIGS. 3 and 5, the lock part 50 is positioned above the engaging part 5 in the state in which the casing 20 is raised. The lock part 50 includes a case part 52, and the tab part 55 located inside the case part 52.

The case part 52 is formed in a box-like shape with an open top. The case part 52 is covered with a not-illustrated cover from above. The case part 52 has a size that is storable inside the engaging part 5. Two insertion through-holes 52*b* through which the tab parts 55 are inserted are provided in a front surface part 52*a* of the case part 52 and separated in the lateral direction. The insertion through-hole 52*b* is located at a position corresponding to the through-hole 5*b* of the engaging part 5.

The case part 52 includes a third guide part 53 that guides a third part 78 of the transmission part 74. As shown in FIGS. and 11, the third guide part 53 is included in the inner wall of the case part 52 and extends in the lateral direction. The third guide part 53 slidably guides the third part 78 of the transmission part 74.

The tab part 55 is positioned inside the case part 52 and is inserted through the insertion through-hole 52*b*. As shown in FIGS. 11 and 13, the tab part 55 can be moved in the longitudinal direction through the insertion through-hole 52*b* by a spring 56. A slanted part 55*b* is provided in an upper surface 55*a* of the tab part 55. The slanted part 55*b* generates a force component causing the tab part 55 to move backward when pressed by the transmission part 74.

As shown in FIG. 4, the tab part 55 is caused to protrude from the through-hole 5*b* of the engaging part 5 by the urging force of the spring 56 in the state in which the casing 20 is not raised. Thereby, because the tab part 55 engages the through-hole 5*b* of the engaging part 5, the upward movement of the casing 20 is restricted. On the other hand, the tab part 55 is detached from the through-hole 5*b* of the engaging part 5 by moving backward when pressed by the transmission part 74 against the urging force of the spring 56. The restriction of the upward movement of the casing 20 is released thereby.

A return spring 58 extends in the lateral direction inside the case part 52. The return spring 58 is compressed by a projection 78*c* of the transmission part 74 when the release part 70 described below is moved to detach the tab part 55 from the through-hole 5*b*. The urging force of the return spring 58 returns the release part 70 to the original position when the pressing of the operation part 72 is released. Also, the return spring 58 provides an operative feel when the operation part 72 is pressed.

A raising part 60 is located in the case part 52. The raising part 60 raises the casing 20 with respect to the toilet 2. The raising part 60 includes a rotation shaft part 62, and a rotation spring 64 that rotates the rotation shaft part 62.

The rotation shaft part 62 includes a first shaft part 62*a* extending in the lateral direction inside the case part 52, and a second shaft part 62*b* extending obliquely downward and frontward from the first shaft part 62*a*. The rotation shaft part 62 is formed in an L-shape made of the first and second shaft parts 62*a* and 62*b*. As shown in FIG. 13, the rotation spring 64 is wound at the outer circumference of the first shaft part 62*a*. The distal end of the second shaft part 62*b* abuts the upper surface of the engaging part 5.

The rotation spring 64 urges the rotation shaft part 62 in a direction to push the casing 20 upward. Thereby, when the tab part 55 is detached from the through-hole 5*b* of the engaging part 5, the rotation shaft part 62 is rotated by the urging force of the rotation spring 64; and the casing 20 is moved upward. The raising part 60 may be provided as necessary. In other words, the raising part 60 is unnecessary when the casing 20 is manually lifted.

The release part 70 will now be described.

The release part 70 extends from the operation part mounting hole 32 toward the interior of the lock part 50. The release part 70 moves the tab part 55 of the lock part 50 to release the restriction of the upward movement of the casing 20 by the lock part 50. The release part 70 includes the operation part 72, and the transmission part 74 that transmits the operating force applied to the operation part 72 to the lock part 50.

The operation part 72 is mounted in the operation part mounting hole 32 of the case plate 30 to be slidable in the lateral direction. The operation part 72 includes an operation surface 72*a* that is part of the appearance of the casing 20. The operation surface 72*a* of the operation part 72 is exposed at the opening 46 of the case cover 40. The operation surface 72*a* of the operation part 72 is the part that is operated (pressed) by the user. The operation part 72 is located at a different position from the lock part 50 in the vertical direction. In the example, the operation part 72 is positioned higher than the lock part 50. The operation surface 72*a* is located at a position separated upward from the lower end 20*a* of the casing 20.

The transmission part 74 extends from the back surface of the operation part 72 toward the interior of the lock part 50. The transmission part 74 moves the tab part 55 by transmitting the operating force (the pressure) of the operation part 72 to the tab part 55. The transmission part 74 includes the first part 75 extending from the back surface of the operation part 72, an extension part 76 extending from the distal end of the first part 75, the second part 77 extending from the distal end of the extension part 76, and the third part 78 extending from the distal end of the second part 77. The transmission part 74 has a crank-like shape made of the first part 75, the extension part 76, the second part 77, and the third part 78.

In the example, the operation part 72, the first part 75, and the extension part 76 are formed as a continuous body. Also, the second part 77 and the third part 78 are formed as a continuous body. The release part 70 is configured so that the extension part 76 and the second part 77 abut. The operation part 72 and the transmission part 74 of the release part 70 also may be formed as a continuous body. Only the operation part 72 of the release part 70 may be a separate body.

The first part 75 is a rod-like body extending in the horizontal direction from the operation part 72. The first part 75 includes a first engaging part 75*a* that slidably engages the first guide part 34 of the case plate 30. The first engaging part 75*a* is located in the side surface part of the first part 75 and is a groove part extending in the lateral direction. The first part 75 moves smoothly in the lateral direction by the first engaging part 75*a* slidably engaging the first guide part 34. As shown in FIG. 7, the first part 75 is positioned at the center of the vertical height dimension of the operation surface 72*a* and extends in the lateral direction. In other words, the first part 75 extends along a centerline O1-O1 of a vertical height dimension H1 of the operation surface 72*a*.

The extension part 76 is a rod-like body extending in the vertical direction. Specifically, the extension part 76 extends obliquely downward from the first part 75 toward the second part 77. In other words, the extension part 76 connects the first part 75 and the second part 77.

As shown in FIG. 7, the extension part 76 extends in the vertical direction from the central position of the vertical height dimension of the operation surface 72*a* toward the second part 77. Specifically, the extension part 76 extends obliquely downward toward the second part 77 from the distal end of the first part 75 positioned at the center of the vertical height dimension of the operation surface 72*a*. It is sufficient for the extension part 76 to be positioned so that a connection part 76*a* with the first part 75 is on the centerline O1-O1 of the vertical height dimension H1 of the operation surface 72*a*. In the example, the connection part 76*a* between the first part 75 and the extension part 76 is positioned on the centerline O1-O1.

A dimension L1 of the extension part 76 in the vertical direction is not less than half of the height dimension H1 from an upper end 72*a*1 to a lower end 72*a*2 of the operation surface 72*a* of the operation part 72. The dimension L1 is, for example, not less than 10 mm. A dimension L2 of the extension part 76 in the lateral direction is not less than the dimension L1 in the vertical direction. The dimension L2 is, for example, not less than 10 mm. In such a case, the dimension L1 is, for example, the dimension in the vertical direction of the sloped surface (in the example, the upper surface) of the extension part 76 facing the center of the casing 20 (the lock part 50 side). The dimension L2 is the dimension in the lateral direction of the sloped surface of the extension part 76. Thereby, the release part 70 is such that the operation part 72 is positioned higher than the lock part 50. The dimensions L1 and L2 of the extension part 76 are set by considering the shape of the case plate 30, the position of the operation part 72, etc.

The second part 77 is a plate-shaped body extending from the extension part 76 toward the lock part 50. The second part 77 includes an erect part 77*a* that is connected to the extension part 76 and extends in the vertical direction, and a horizontal part 77*b* extending frontward from the lower end of the erect part 77*a*. As shown in FIGS. 7 and 10, the erect part 77*a* is connected to the extension part 76 at the right end side.

As shown in FIGS. 8 and 12, the erect part 77*a* includes a second engaging part 77*c* that slidably engages the second guide part 36 of the case plate 30. The second engaging part 77*c* is located at the back surface lower end side of the erect part 77*a* and is a notched groove part extending in the lateral direction. The movement of the second engaging part 77*c* in the lateral direction is smooth because the second part 77 slidably engages the second guide part 36. The erect part 77*a* is formed of a plate-shaped body and is clamped by the wall surfaces of the case plate 30 in the longitudinal direction. The movement of the second part 77 in the lateral direction is made smooth thereby. The second part 77 is not limited to a plate-shaped body and may be formed of a rod-like body.

The third part 78 extends from the second part 77 toward the interior of the lock part 50. The third part 78 moves the tab part 55 of the lock part 50 by moving in the lateral direction. A side part 78*a* of the third part 78 slidably abuts the third guide part 53 of the case part 52. The movement of the third part 78 in the lateral direction is smooth due to the third guide part 53.

As shown in FIG. 13, the third part 78 includes a pressing part 78*b* that presses the slanted part 55*b* of the tab part 55. The pressing part 78*b* presses the slanted part 55*b* in the lateral direction. Thereby, a backward force is applied to the tab part 55 by the slant of the slanted part 55*b*.

As shown in FIGS. 11 and 13, the third part 78 includes a projection 78*c* that is located inside the case part 52 and presses the return spring 58. The projection 78*c* presses the return spring 58 when the operation part 72 is pressed. Then, when the operation of the operation part 72 is ceased, the projection 78*c* is returned by the urging force of the return spring 58. Thereby, the release part 70 is returned to the original position.

The toilet device 1 according to the embodiment has the configuration described above, and the operation of raising the casing 20 will now be described.

For example, the toilet seat device 10 (the casing 20) can be raised with respect to the toilet 2 when cleaning the upper surface 2*b* of the toilet 2. When the casing 20 is not raised, the tab part 55 of the lock part 50 is inserted into the through-hole 5*b* of the engaging part 5 fixed to the toilet 2. The upward movement of the casing 20 with respect to the toilet 2 is restricted thereby.

When the casing 20 is raised, the operation part 72 that is positioned at the side surface part 40*b* of the case cover 40 is pressed. Thereby, the transmission part 74 is moved leftward, and the tab part 55 of the lock part 50 is moved backward. As a result, the restriction of the upward movement of the casing 20 with respect to the toilet 2 is released because the tab part 55 is detached from the through-hole 5*b* of the engaging part 5. The casing 20 can be raised by the raising part 60 when the restriction of the upward movement of the casing 20 is released (see FIGS. 3 and 5). A hand can be inserted between the casing 20 and the upper surface 2*b* of the toilet 2; and the upper surface 2*b* of the toilet 2 can be cleaned thereby.

The casing 20 is pressed from above to return the casing to the original position. Thereby, the tab part 55 is moved backward against the urging force of the spring 56 by the front surface part 5*a* of the engaging part 5. Then, when the tab part 55 reaches the position of the through-hole 5*b*, the tab part 55 is inserted into the through-hole 5*b* by the urging force of the spring 56. The upward movement of the casing 20 with respect to the toilet 2 is restricted thereby.

The positional relationship of the operation part 72 will now be described.

As shown in FIG. 2, the operation part 72 is located in the side surface part 40*b* of the case cover 40 included in the casing 20. In other words, the operation part 72 is located at a position separated upward from the lower end 20*a* of the casing 20. The operation part 72 is located at a position that is a distance L3 above the lower end 20*a* of the casing 20. The distance L3 is, for example, not less than 1 mm.

By providing the operation part 72 at a position that is separated from the lower end 20*a* of the casing 20, for example, the lower end 20*a* side of the casing 20 can be formed in one straight line in the longitudinal direction. As a result, the designability of the toilet device 1 can be improved.

As shown in FIG. 1, the operation part 72 is covered with the toilet lid 24 when the toilet lid 24 is in the closed state. Specifically, the toilet lid 24 includes the side surface part 24*b* that covers at least a part of the side surface part 40*b* of the case cover 40. The operation part 72 is located at a position that is covered with the side surface part 24*b* when the toilet lid 24 is in the closed state. Thereby, the designability of the toilet device 1 can be improved because the operation part 72 is not visible in the state in which the toilet lid 24 is closed.

Figure 14:
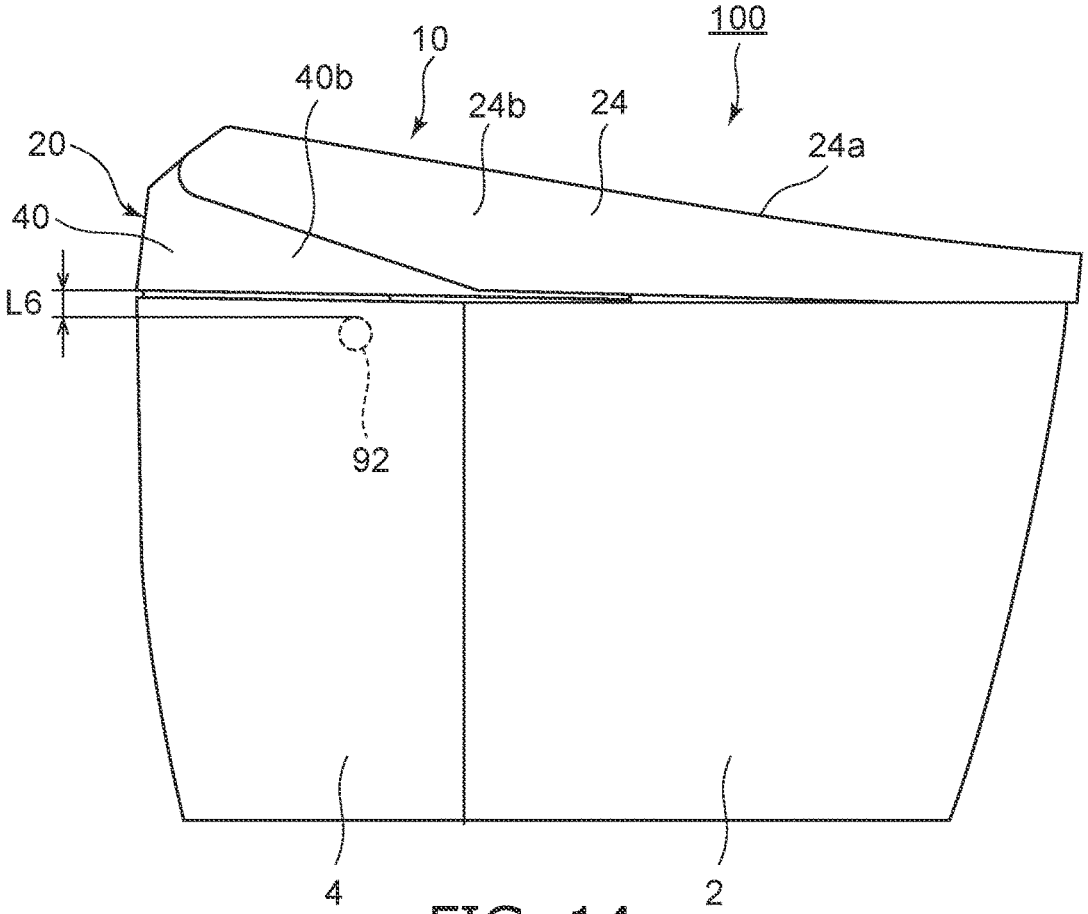
FIG. 14 is a side view showing the toilet device according to the second embodiment of the invention.
Figure 15:
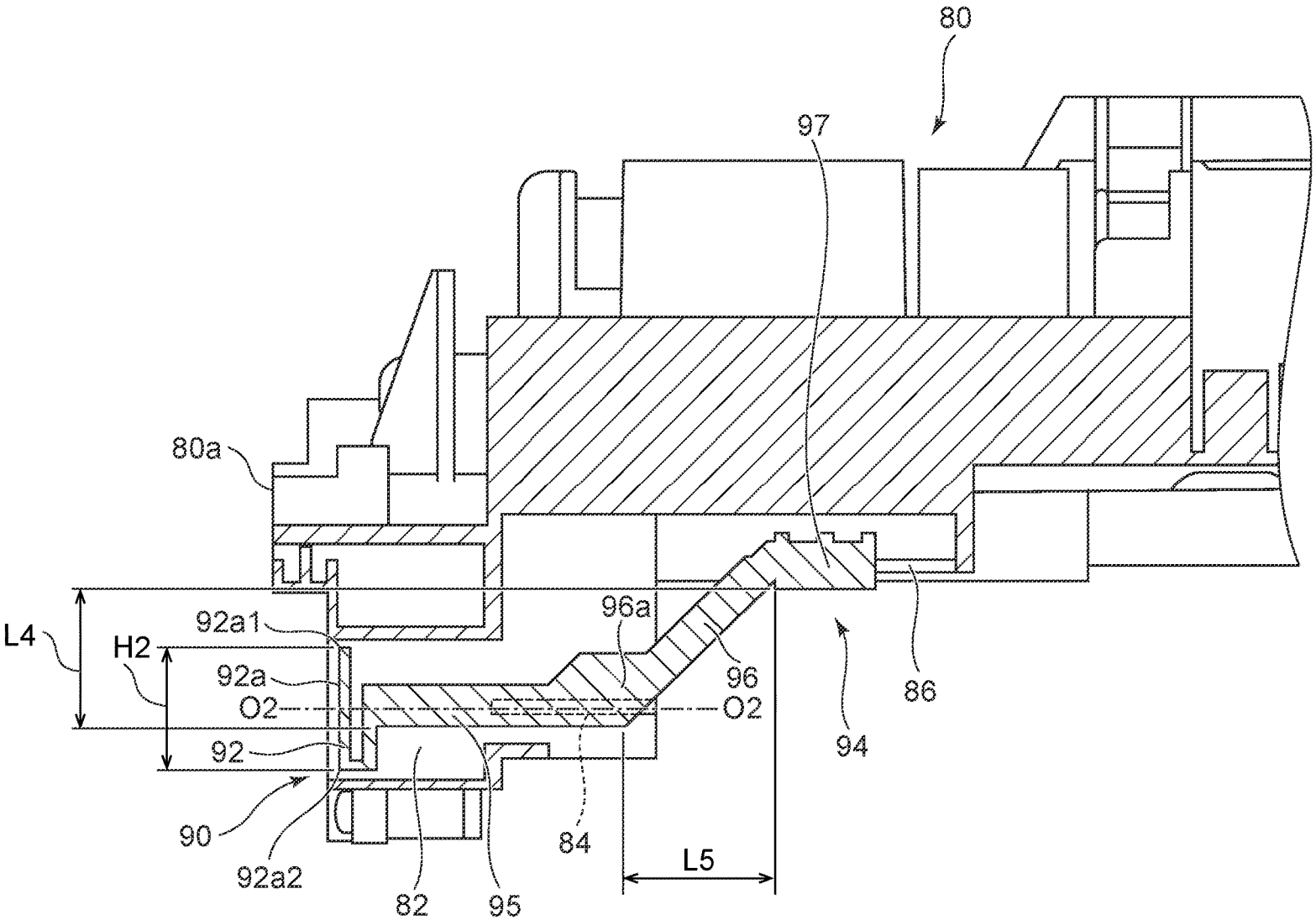
FIG. 15 is a cross-sectional view similar to FIG. 7 and shows the case plate and the release part.
Figure 16:
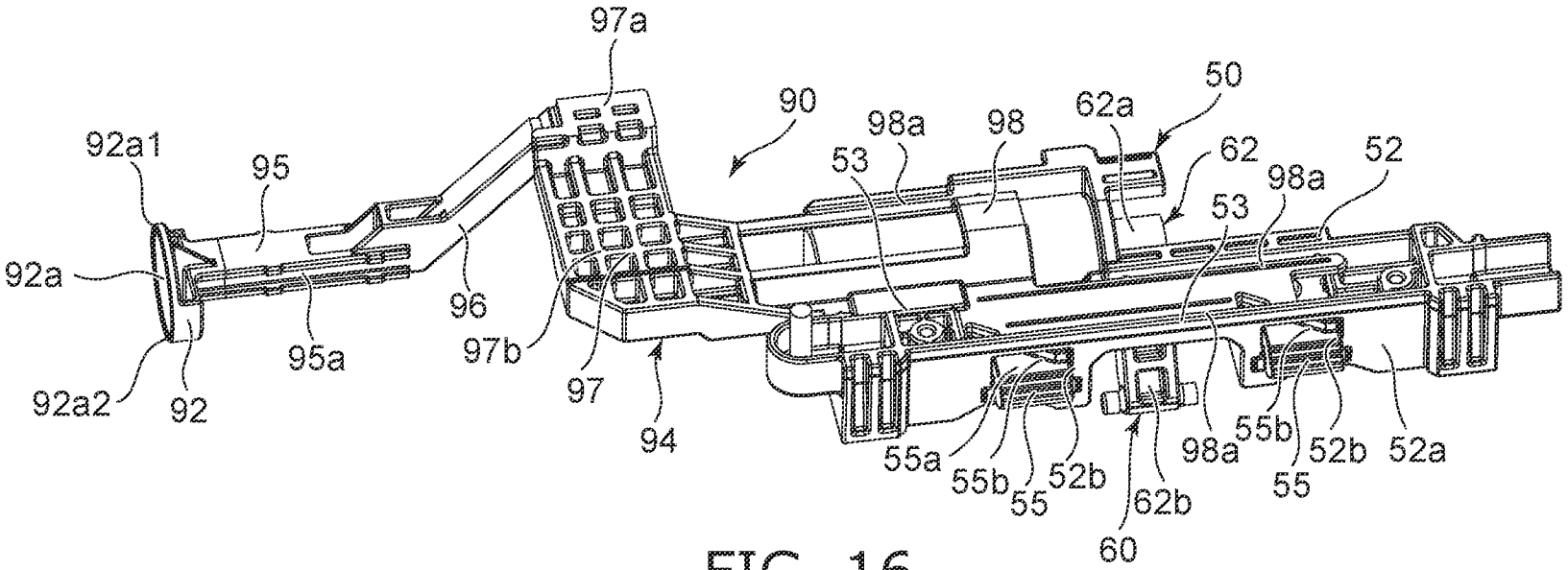
FIG. 16 is a perspective view showing the lock part and the release part.

FIGS. 14 to 16 show a toilet device 100 according to a second embodiment of the invention. The second embodiment is distinctive in that the operation part is located below the lower end of the casing. The same components as those of the first embodiment described above are marked with the same reference numerals in the second embodiment; and a description is omitted.

FIG. 14 is a side view showing the toilet device according to the second embodiment of the invention.

FIG. 15 is a cross-sectional view similar to FIG. 7 and shows the case plate and the release part.

FIG. 16 is a perspective view showing the lock part and the release part.

An operation part mounting hole 82 in which an operation part 92 is mounted is provided in a side surface part 80*a* of a case plate 80. The operation part mounting hole 82 is a through-hole that extends in the lateral direction. As shown in FIG. 15, the operation part mounting hole 82 is positioned at the lower end side of the case plate 80. In other words, the operation part mounting hole 82 is positioned lower than the lock part 50. The operation part mounting hole 82 is positioned at the backside of the side surface cover 4. In other words, the operation part mounting hole 82 is positioned lower than the side surface part 40*b* of the case cover 40 in the state in which the case cover 40 is mounted to the case plate 80. The case plate 80 includes a first guide part 84 and a second guide part 86 that guide a transmission part 94.

The first guide part 84 is next to the operation part mounting hole 82 in the lateral direction. The first guide part 84 is a rail part extending in the lateral direction from the operation part mounting hole 82. In other words, the first guide part 84 extends in the same direction as the axial direction of the operation part mounting hole 82. Two first guide parts 84 face each other in the longitudinal direction and protrude from the wall surfaces. The first guide parts 84 slidably guide a first part 95 of the transmission part 94.

The second guide part 86 is positioned higher than the first guide part 84 and further toward the central part. For example, the second guide part 86 is located at the same position as the second guide part 36 according to the first embodiment. In other words, the second guide part 86 is positioned at substantially the same height as the upper end of the lock part 50 and is located between the first guide part 84 and the lock part 50. The second guide part 86 is a rail part extending in the lateral direction and protrudes from the wall surface. The second guide part 86 slidably guides a second part 97 of the transmission part 94.

A release part 90 includes the operation part 92, and the transmission part 94 that transmits the operating force applied to the operation part 92 to the lock part 50. The operation part 92 is mounted in the operation part mounting hole 82 of the case plate 80 to be slidable in the lateral direction. An operation surface 92*a* of the operation part 92 is covered with the side surface cover 4. The operation surface 92*a* of the operation part 92 is the part that is operated (pressed) by the user. The operation part 92 is located at a different position from the lock part 50 in the vertical direction. In the example, the operation part 92 is positioned lower than the lock part 50.

The transmission part 94 extends from the back surface of the operation part 92 toward the interior of the lock part 50. The transmission part 94 includes the first part 95 extending from the back surface of the operation part 92, an extension part 96 extending from the distal end of the first part 95, the second part 97 extending from the distal end of the extension part 96, and a third part 98 extending from the distal end of the second part 97. The transmission part 94 has a crank-like shape made of the first part 95, the extension part 96, the second part 97, and the third part 98.

In the example, the operation part 92, the first part 95, and the extension part 96 are formed as a continuous body. In such a case, for example, the operation part 92, the first part 95, and the extension part 96 are formed as a continuous body that is the same member as the operation part 72, the first part 75, and the extension part 76 formed as a continuous body according to the first embodiment, and is used by being inverted in the vertical direction. The operation part 92, the first part 95, and the extension part 96 that are formed as a continuous body may be a member other than the operation part 72, the first part 75, and the extension part 76 formed as a continuous body.

The first part 95 includes a first engaging part 95*a* that slidably engages the first guide part 84 of the case plate 80. The first engaging part 95*a* is located in the side surface part of the first part 95 and is a groove part extending in the lateral direction. The movement of the first part 95 in the lateral direction is smooth due to the first engaging part 95*a* slidably engaging the first guide part 84. As shown in FIG. 15, the first part 95 is positioned at the center of the vertical height dimension of the operation surface 92*a* and extends in the lateral direction. In other words, the first part 95 extends along a centerline O2-O2 of a vertical height dimension H2 of the operation surface 92*a*.

The extension part 96 is a rod-like body extending in the vertical direction. Specifically, the extension part 96 extends obliquely upward from the first part 95 toward the second part 97. In other words, the extension part 96 connects the first part 95 and the second part 97.

As shown in FIG. 15, the extension part 96 extends in the vertical direction from the central position of the vertical height dimension of the operation surface 92*a* toward the second part 97. Specifically, the extension part 96 extends obliquely upward toward the second part 97 from the distal end of the first part 95 positioned at the center of the vertical height dimension of the operation surface 92*a*. It is sufficient for the extension part 96 to be positioned so that a connection part 96*a* with the first part 95 is on the centerline O2-O2 of the vertical height dimension H2 of the operation surface 92*a*. In the example, the connection part 96*a* between the first part 95 and the extension part 96 is positioned on the centerline O2-O2.

A dimension L4 of the extension part 96 in the vertical direction is not less than half of the height dimension H2 from an upper end 92*a*1 to a lower end 92*a*2 of the operation surface 92*a* of the operation part 92. The dimension L4 is, for example, not less than 10 mm. A dimension L5 of the extension part 96 in the lateral direction is not less than the dimension L4 in the vertical direction. The dimension L5 is, for example, not less than 10 mm. The dimension L4 is, for example, the dimension in the vertical direction of the sloped surface (in the example, the lower surface) of the extension part 96 facing the center of the casing 20 (the lock part 50 side). The dimension L5 is the dimension in the lateral direction of the sloped surface of the extension part 96. Thereby, the release part 90 is such that the operation part 92 is positioned lower than the lock part 50. The dimensions L4 and L5 of the extension part 96 are set by considering the shape of the case plate 80, the position of the operation part 92, etc.

The second part 97 includes an erect part 97*a* connected to the extension part 96, and a horizontal part 97*b* extending frontward from the erect part 97*a*. Other than having a smaller height dimension, the erect part 97*a* has the same configuration as the erect part 77*a* according to the first embodiment. A second engaging part (not illustrated) is located at the back surface lower end side of the erect part 97*a*. The second engaging part has a shape similar to the second engaging part 77*c* according to the first embodiment, and is a notched groove part extending in the lateral direction. The movement of the second part 97 in the lateral direction is smooth due to the second engaging part slidably engaging the second guide part 86.

The third part 98 has a shape and configuration that are similar to those of the third part 78 according to the first embodiment. The third part 98 extends from the second part 97 toward the interior of the lock part 50. The third part 98 moves the tab part 55 of the lock part 50 by moving in the lateral direction. A side part 98*a* of the third part 98 slidably abuts the third guide part 53 of the case part 52. The movement of the third part 98 in the lateral direction is smooth due to the third guide part 53.

As shown in FIG. 14, the operation part 92 of the toilet device 100 is located at the backside of the side surface cover 4 that seals the space positioned backward of the toilet 2. In other words, the operation part 92 is located at a position separated downward from the lower end 20*a* of the casing 20. The operation part 92 is located at a position that is a distance L6 below the lower end 20*a* of the casing 20. The distance L6 is, for example, not less than 1 mm. When raising the casing 20, the operation part 92 is operated (pressed) by detaching the side surface cover 4.

Thus, actions and effects that are similar to those of the first embodiment can be obtained according to the second embodiment thus configured. According to the second embodiment, the designability of the toilet device 100 can be improved because the operation part 92 is covered with the side surface cover 4 and is not visible.

The toilet device 1 that is described as an example according to the first embodiment above includes a space storing functional units backward of the toilet 2. However, the form of the invention is not limited thereto; for example, the toilet device may include a flat upper surface backward of the toilet, and the movement of the casing may be restricted by the tab part of the lock part engaging a base plate fixed to the upper surface.

The extension part is slanted in the example according to the first embodiment described above. However, the form of the invention is not limited thereto; for example, the extension part may be formed in an L-shape.

The operation part 72 is positioned higher than the lower end 20*a* of the casing 20 in the example according to the first embodiment described above, and the operation part 92 is positioned lower than the lower end 20*a* of the casing 20 in the example according to the second embodiment described above. However, the form of the invention is not limited thereto; for example, operation parts may be located both higher and lower than the lower end of the casing.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. For example, the shape, the dimension, the material, the disposition, the installation feature or the like of the components included in the toilet device are not limited to the illustration and can be appropriately modified. The components included in the embodiments described above can be combined within the extent of technical feasibility, and any combined components also are included in the scope of the invention to the extent that the feature of the invention is included.

What is claimed is:

1. A toilet device, comprising:

a casing mounted to an upper surface of a toilet;

a lock part restricting movement of the casing with respect to the toilet; and a release part releasing the restricting by the lock part, the release part including an operation part, and a transmission part transmitting an operating force to the lock part, the operating force being applied to the operation part, the operation part being located at a position separated upward or downward from a lower end of the casing, the operation part being positioned higher than the lower end of the casing, or positioned lower than the lower end of the casing, wherein the operation part is located at a different position from the lock part in a vertical direction, and the transmission part includes an extension part extending in the vertical direction, wherein the transmission part includes:

a first part extending in a horizontal direction from the operation part;

the extension part extending from the first part; and a second part extending from the extension part toward the lock part, and the casing includes:

a first guide part guiding the first part; and a second guide part guiding the second part, and wherein the extension part connects the first part and the second part, and the extension part extends obliquely downward or upward from the first part toward the second part.

2. The device according to claim 1, wherein the operation part includes an operation surface operated by a user, and the operation surface is located at a position separated upward or downward from the lower end of the casing.

3. The device according to claim 1, wherein the lock part includes:

a case part; and a tab part located in the case part, the tab part restricting a movement of the casing, the transmission part includes a third part, the third part extends from the second part toward an interior of the lock part and moves the tab part, and the case part includes a third guide part guiding the third part.

4. The device according to claim 1, wherein the extension part extends toward the second part from a central position of a vertical height dimension of an operation surface of the operation part, and a dimension in the vertical direction of the extension part is not less than half of a length from an upper end to a lower end of the operation surface of the operation part.

5. The device according to claim 4, wherein a dimension of the extension part in a lateral direction is not less than a dimension of the extension part in the vertical direction.

6. The device according to claim 1, wherein the operation part is located at a position that is not less than 1 mm in a vertical direction from the lower end of the casing.

7. The device according to claim 1, further comprising:

a toilet lid openable and closable with respect to the casing, the operation part being located at a position separated upward from the lower end of the casing, the operation part being covered with the toilet lid when the toilet lid is in a closed state.

* * * * *